US007048405B2

(12) United States Patent
Lee

(10) Patent No.: US 7,048,405 B2
(45) **Date of Patent: *May 23, 2006**

(54) INNOVATED FLASHING DECORATIVE ARTICLE

(76) Inventor: Ching-Hui Lee, P.O. Box 590, Taichung City, Taichung (TW) 400

( * ) Notice: Subject to any disclaimer, the term of this patent is extended or adjusted under 35 U.S.C. 154(b) by 57 days.

This patent is subject to a terminal disclaimer.

(21) Appl. No.: 10/443,907

(22) Filed: May 23, 2003

(65) Prior Publication Data

US 2004/0037071 A1 Feb. 26, 2004

(30) Foreign Application Priority Data

Sep. 21, 2002 (CN) ..... 02 2 49240

(51) Int. Cl.
*F21L 4/04* (2006.01)

(52) U.S. Cl. ..... 362/121; 362/103; 362/186; 362/191; 362/398; 362/807

(58) Field of Classification Search ..... 362/190, 362/191, 196, 202, 203, 398, 103, 121, 186, 362/807, 116, 198, 200, 201, 806
See application file for complete search history.

(56) References Cited

U.S. PATENT DOCUMENTS 4,692,846 A * 9/1987 Johnson ..... 362/104
5,178,453 A * 1/1993 Runels ..... 362/398
5,465,197 A * 11/1995 Chien ..... 362/202
5,934,784 A * 8/1999 Dion ..... 362/103
6,013,346 A * 1/2000 Lewis et al. ..... 428/78
6,341,874 B1 * 1/2002 Rubin ..... 362/103
6,547,412 B1 * 4/2003 Piparo-Haase et al. ..... 362/104
6,773,133 B1 * 8/2004 Lee ..... 362/121

* cited by examiner

*Primary Examiner*—John Anthony Ward
(74) *Attorney, Agent, or Firm*—Rosenberg, Klein & Lee

(57) ABSTRACT

An innovated flashing decorative article, comprising of an upper hollow pipe, a lower hollow pipe and an exterior magnet. On the top rim of the upper hollow pipe are two symmetrically positioned insert pins and a circuit board that is connected via the insert pins to the upper hollow pipe. On the circuit board are an IC and LED. The upper side of the circuit board is coated with transparent glue. Inside the upper hollow pipe is an insulating paper. At a lower part of the upper hollow pipe is an exterior pipe thread. Inside the lower hollow pipe is an interior pipe thread. On the bottom of the lower hollow pipe is a magnet. Inside the hollow of the lower hollow pipe are one to three batteries. The exterior pipe thread and interior pipe thread of the upper and lower hollow pipes are screwed together. The exterior magnet is independently installed outside the upper and lower hollow pipes. Due to variability of the shape of the circuit board, the present invention of flashing decorative article provides more fun. By screwing the upper and lower hollow pipes together, the circuit board is activated to turn on the LED lamp, which serves as a switch. The product is compact to carry and easy to use.

4 Claims, 3 Drawing Sheets

INNOVATED FLASHING DECORATIVE ARTICLE

BACKGROUND OF THE INVENTION (a) Field of the invention

The present invention relates to an innovated flashing decorative article.

(b) Description of the Prior Art

Most conventional decorative articles are without flashing light and lack of amusement effect. Though a few decorative articles may have light flashing function, they will not function until they are switched on. Therefore, the additional switch mechanism complicates the construction of the product.

BRIEF DESCRIPTION OF THE INVENTION

The present invention comprises an upper hollow pipe, a lower hollow pipe and an exterior magnet. On the rim of the top of the upper hollow pipe are two symmetrically positioned insert pins and a circuit board that is connected via the insert pins to the upper hollow pipe. On the circuit board is an Integrated Circuit chip (IC) and a Light Emitting Diode, LED. The upper side of the circuit board is coated with a layer of transparent glue. Inside the upper hollow pipe is a ring of insulating paper. At a lower part of the upper hollow pipe is an exterior pipe thread. Inside the lower hollow pipe is an interior pipe thread. On the bottom of the lower hollow pipe is a magnet. Inside the hollow of the upper and lower hollow pipes are one to three batteries. The exterior pipe thread and the interior pipe thread of the upper and lower hollow pipes are screwed together. The exterior magnet on the outside of the upper and lower hollow pipes is optionally replaced by a metal ring installed on the bottom of the lower hollow pipe, forming a ring shape.

Due to the variability of the shape of the circuit board and the LED installed on the circuit board, the present invention of light flashing decorative article has the effect of fin and amusement. Besides, tightening of the upper hollow pipe with the lower hollow pipe activates the circuit board, which in turn turns on the LED. This function serves as a switch, enabling compact construction and convenient use of the present invention.

DETAILED DESCRIPTION OF PREFERRED EMBODIMENTS

Figure 1:
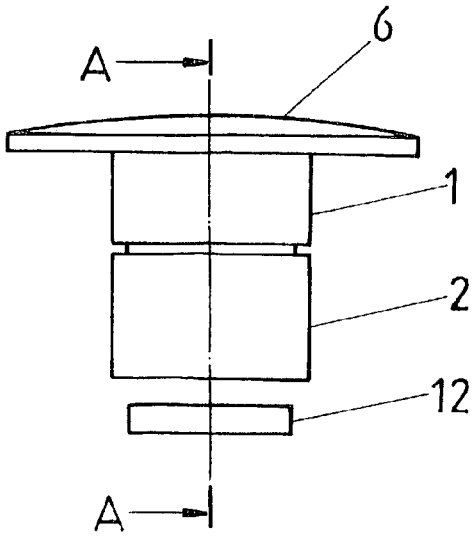
FIG. 1 is a side view of the invention.
Figure 2:
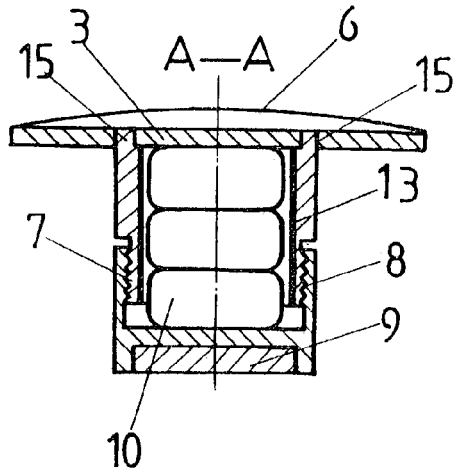
FIG. 2 is a section view taken from A—A of FIG. 1 without the exterior magnet.
Figure 3:
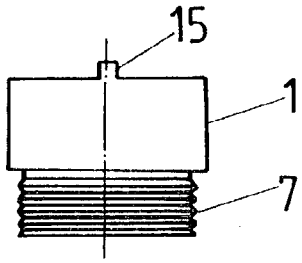
FIG. 3 is a side view of the upper hollow pipe in the invention.
Figure 4:
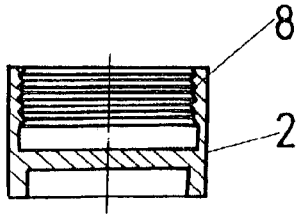
FIG. 4 is a side view of the lower hollow pipe in the invention.

As shown in FIGS. 1 through 5, the present invention comprises an upper hollow pipe 1, a lower hollow pipe 2 and an exterior magnet 12. On the rim of the top of the upper hollow pipe 1 are two symmetrically positioned insert pins 15 and a circuit board 3 that is connected via the two insert pins 15 to the upper hollow pipe 1. On the circuit board 3 are an IC 4 and an LED 5. The upper side of the circuit board 3 is coated with transparent glue 6. Inside the upper hollow pipe 1 is a ring of insulating paper 13. At the lower part of the upper hollow pipe 1 is an exterior pipe thread 7. Inside the lower hollow pipe 2 is an interior pipe thread 8. At the bottom of the lower hollow pipe 2 is a magnet 9. Inside the hollow of the upper and lower hollow pipes 1 and 2 are three batteries 10. The upper and lower hollow pipes 1,2 are joined by screwing the exterior pipe thread 7 with the interior pipe thread 8. The exterior magnet 12 is independently installed on the outside of the upper and lower hollow pipes.

Figure 5:
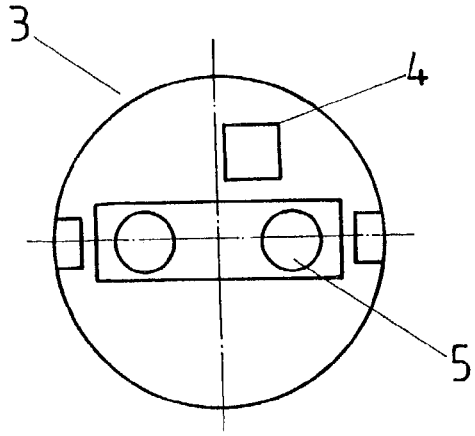
FIG. 5 is a top view of the circuit board in the invention.
Figure 6:
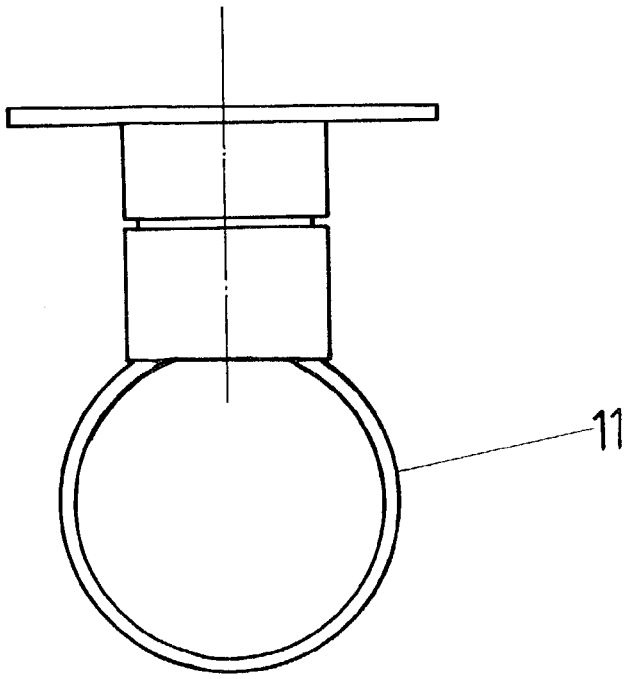
FIG. 6 is a schematic view of an embodiment of the invention.
Figure 8:
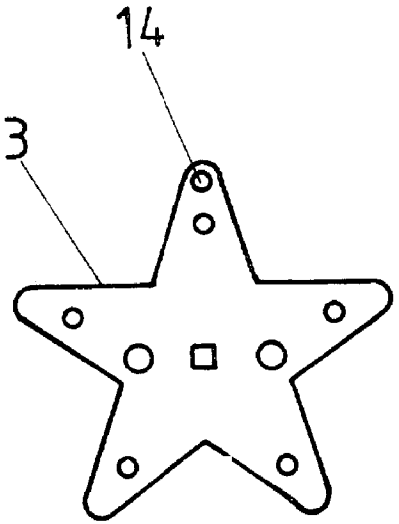
FIG. 8 is another embodiment view of the circuit board in the invention.
Figure 7:
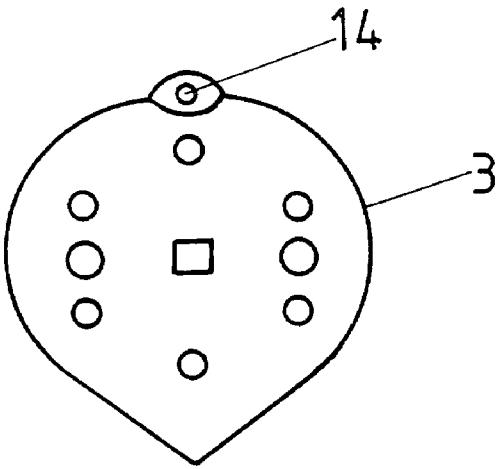
FIG. 7 is an embodiment view of the circuit board in the invention.

As shown in FIGS. 5, 7 and 8, the circuit board 3 is optionally shaped like a circle, a heart and a star. On the top of the circuit board 3 is a round hole 14. Optionally, there is a transparent plastic unit or glass unit on the outside of the circuit board 3 to join firmly with the upper hollow pipe 1. Optionally, the exterior magnet 12 outside the upper and lower hollow pipes 1, 2 is replaced by a metal ring 11 installed on the bottom of the lower hollow pipe 2 (as shown in FIG. 6), forming a ring shape.

What is claimed is:

1. A innovated flashing decorative article, comprising:

a circuit board, on said circuit board being IC and LED, the upper side of the circuit board being coated with a layer of transparent glue;

an upper hollow pipe, inside the upper hollow pipe being a ring of insulating paper, at a lower part of the upper hollow pipe being an exterior pipe thread, on a rim of a top of said upper hollow pipe being two symmetrically positioned insert pins, and a circuit board that is connected via the insert pins to the upper hollow pipe;

a lower hollow pipe, inside the lower hollow pipe being an interior pipe thread, at a bottom of the lower hollow pipe being a magnet, the exterior pipe thread and interior pipe thread of the upper and lower hollow pipes can be screwed together;

a plurality of batteries, installed at an inner space formed by above cited the upper and lower hollow pipes when screwed together, and an exterior magnet, the exterior magnet being independently installed outside of the upper and lower hollow pipes, the said exterior magnet attracted to the bottom magnet of the lower hollow pipe providing a clamping facility for carrying and locating the claimed flashing decorative article in position.

2. The innovated flashing decorative article of claim 1, characterized in that, the circuit board is optionally shaped like a circle, a heart or a star.

3. The innovated flashing decorative article of claim 1, characterized in that, the exterior magnet outside the upper and lower hollow pipes could be optionally replaced by a metal ring attached to a bottom of the lower hollow pipe, thereby forming a ring shape.

4. The innovated flashing decorative article of claim 1, characterized in that, the circuit board has a transparent plastic unit or a glass unit outside the circuit board for tight fastening purpose to the upper hollow pipe.

* * * * *